US006726044B1

(12) United States Patent
Deubel et al.

(10) Patent No.: US 6,726,044 B1
(45) Date of Patent: Apr. 27, 2004

(54) CONTAINER HAVING EXPANDABLE NECK

(75) Inventors: Donald Deubel, New Lenox, IL (US); Aron F. Wark, Romeoville, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 10/183,183

(22) Filed: Jun. 25, 2002

Related U.S. Application Data

(60) Provisional application No. 60/300,844, filed on Jun. 25, 2001.

(51) Int. Cl.[7] ..... B65D 1/02

(52) U.S. Cl. ..... 215/381; 215/40

(58) Field of Search ..... 215/40, 42, 379, 215/381, 384, 900, 12.1; 220/607, 666, 675

(56) References Cited

U.S. PATENT DOCUMENTS

| | | | | | |
|---|---|---|---|---|---|
| 4,749,092 | A | * | 6/1988 | Sagiura et al. | 215/381 |
| 5,021,515 | A | | 6/1991 | Cochran et al. | 525/371 |
| 5,067,622 | A | * | 11/1991 | Garver et al. | 215/381 |
| 5,407,086 | A | * | 4/1995 | Ota et al. | 215/381 |
| 5,411,699 | A | | 5/1995 | Collette et al. | 264/523 |
| 5,740,934 | A | * | 4/1998 | Brady | 215/381 |
| 5,762,221 | A | * | 6/1998 | Tobias et al. | 215/381 |
| 5,908,128 | A | * | 6/1999 | Krishnakumar et al. | 215/381 |
| 6,016,932 | A | * | 1/2000 | Gaydosh et al. | 215/382 |
| 6,044,996 | A | * | 4/2000 | Carew et al. | 215/381 |
| 6,123,211 | A | * | 9/2000 | Rashid et al. | 215/12.1 |
| 6,176,382 | B1 | | 1/2001 | Bazlur Rashid | 215/373 |
| 6,179,142 | B1 | * | 1/2001 | Hansen | 215/382 |
| 6,257,433 | B1 | * | 7/2001 | Ogg et al. | 215/381 |

FOREIGN PATENT DOCUMENTS

DE 2414945 * 10/1975

OTHER PUBLICATIONS

U.S. patent application Publication No. 2002/0070193 A1 to MERO, Published Jun. 12, 2002.*

* cited by examiner

*Primary Examiner*—Sue A. Weaver
(74) *Attorney, Agent, or Firm*—Woodcock Washburn LLP

(57) ABSTRACT

A container is disclosed having an outwardly protruding bulge in its neck that expands in response to an increase in internal container pressure, thereby partially relieving the internal pressure increase, which benefits the label appearance and adherence characteristics, and enables the base to be reduced in weight.

17 Claims, 3 Drawing Sheets

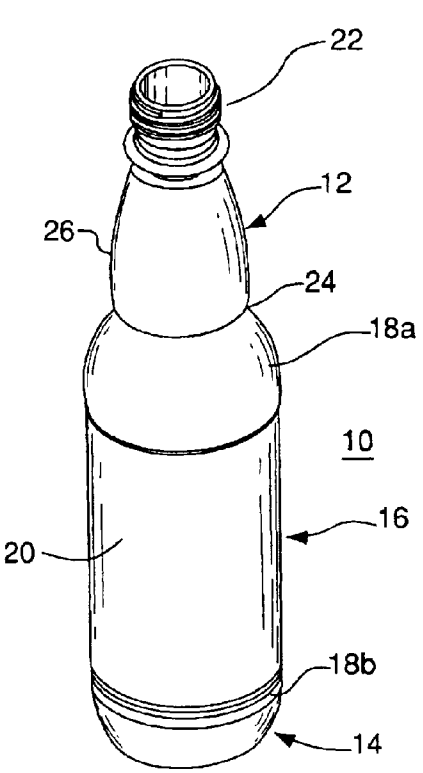
FIG. 1
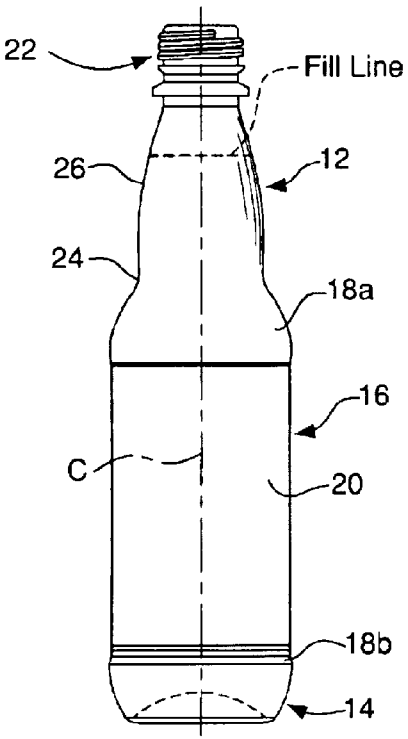
FIG. 2
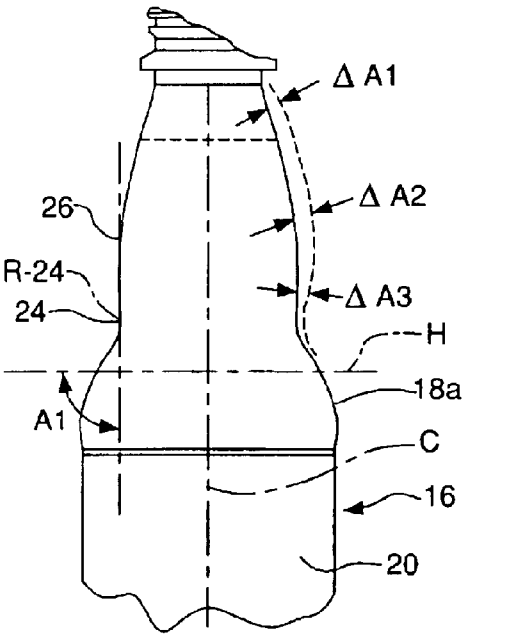
FIG. 5
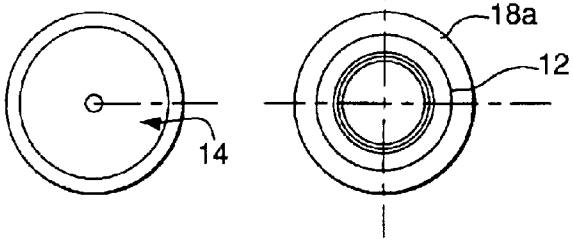
FIG. 3
FIG. 4

CONTAINER HAVING EXPANDABLE NECK

This application claims the benefit of U.S. Provisional Application No. 60/300,844 filed Jun. 25, 2001, which is incorporated by reference herein.

BACKGROUND

The present invention relates to plastic containers, and more particularly to plastic containers for holding carbonated or like products that expand after sealing or capping.

Plastic bottles are in widespread use for containing beverages and food products. A particular type of bottle, which is filled with products at elevated temperatures, is designed to accommodate internal vacuum pressure developed upon cooling of the products after sealing. Often, hot fill bottles include panels formed in the container sidewall that inwardly flex or deform in response to formation of an internal vacuum. For example, U.S. Provisional Patent Application No. 60/295,911, filed Jun. 4, 2001, entitled "Hot-Fillable Container With Grip" discloses a bottle in which inward, vacuum-induced deformation is distributed outside of the handgrip panel.

Another type of plastic bottle that contains carbonated beverages (or like products that exhibit increased internal bottle pressure—that is, compared with the internal pressure upon or soon after capping or sealing) is designed to accommodate internal positive pressure (that is, pressure greater than the ambient atmosphere). Such bottles, which will be referred to herein as "pressurized bottles," are typically formed of blow-molded PET that is capable, upon orienting, of containing an internal bottle pressure of several atmospheres, which may occur when carbonated contents within a bottle are exposed to elevated temperatures, such as 100 degrees F. to 120 degrees F. Such temperatures may be encountered during storage or during transport while the bottle is not in an air-conditioned environment, or like circumstances.

Plastic bottle production is, of course, a competitive industry in which weight-reducing techniques produce significant costs savings, especially in light of the vast quantity of bottles produced worldwide. However, the high internal pressures that pressurized bottles must contain provides a constraint against bottle weight reduction.

U.S. Pat. No. 6,176,382, entitled "Plastic Container Having Base with Annular Wall and Method of Making the Same," discloses a conventional beer bottle shape that may be subject to high internal pressures due to the carbonated (or otherwise pressurized, such as for example by nitrogen) beverage contained therein being exposed to elevated temperature. In this regard, as in most conventional beer bottles and many other pressurized bottles, the exemplary bottle 110 shown in FIG. 7 (PRIOR ART) has a tapered neck 112 extending above a right circular body 116. A shoulder 118 is disposed between neck 112 and body 116. A label panel 120 is defined by at least a portion of body 116. Neck 112 may also receive a label (not shown in the Figures).

Neck 112 has a continuous taper so as to form a frustum of a right circular cone. In this regard, a neck diameter D-PA1 near an upper end of neck 12 is less than a diameter D-PA2 near a lower end of neck 12. Another conventional glass bottle shape (not shown in the Figures) has an upper neck diameter that is the same as the lower neck diameter such that the neck substantially forms a cylinder having a circular cross section. In this regard, the term "straight" or "straight portion" will be employed to refer to a sidewall or a sidewall portion, respectively, that is rectilinear or not curved in longitudinal cross section.

Referring again to FIG. 7, the straight sidewalls of neck 112 and body 116 deform in response to an increase in internal pressure, as indicated diagrammatically by the dashed lines in FIG. 7. The maximum radial expansion is indicated by Δ-PA-neck and Δ-PA-body, respectively. Typically, the volumetric expansion of the neck is less than the volumetric expansion of the body and/or the base.

Often, a plastic bottle is developed to replace a corresponding glass container with economic advantages that are apparent. In some circumstances, technical problems must be solved to make a plastic bottle that is commercially satisfactory. For example, a plastic bottle containing a carbonated (or otherwise pressurized) product inherently yields more than a corresponding glass container in response to an increase in internal pressure. Thus, a label panel of a plastic pressurized bottle may deform in response to an increase in internal pressure. Such label panel expansion is undesirable for aesthetic reasons and because the label may tend to separate from the label panel. Further, the bottle base may tend to bulge or "roll out" in response to such internal pressure, thereby making the base unstable.

In order to produce a bottle that is sufficiently strong to withstand such internal pressure without unacceptable label expansion and/or base expansion or roll-out, bottles formed of oriented thermoplastic are designed with a sidewall and base of sufficient thickness and weight. In general, there is a need for pressurized bottles that have improved expansion characteristics, and/or reduced weight.

SUMMARY

A bottle is provided that includes a neck that expands volumetrically in response to an increase in internal bottle pressure. In this regard, such a plastic container comprises a body, a base extending from the body and enclosing a lower end of the container, a finish disposed at an upper end of the container, and a neck disposed between the finish and the body. The neck includes an outwardly convex portion that radially expands in response to positive internal pressure, whereby the maximum magnitude of the radial expansion is less than a maximum magnitude of radial expansion for a frusto-conical neck of like dimension.

Further, the bottle may include a waist that is outwardly concave such that the convex portion of the neck extends upwardly from and smoothly yields from the waist. Thus, the waist may form a hinge point relative to the convex portion. According to another aspect, the neck's convex portion expansion may diminish expansion of the body straight sidewall, thereby enhancing the appearance and adherence of the label. Also, such expansion may enable the total weight of the bottle to be reduced.

BRIEF DESCRIPTION OF THE FIGURES

FIG. 1 is a perspective view of a bottle according to an embodiment of the present invention;

FIG. 4 is a bottom view of the bottle of FIG. 1;

FIG. 3 is a top view of the bottle of FIG. 1;

FIG. 4 is a top bottom of the bottle of FIG. 1;

FIG. 5 is an enlarged longitudinal cross sectional view of a portion of the bottle of FIG. 1;

DESCRIPTION OF PREFERRED EMBODIMENTS

Figure 6:
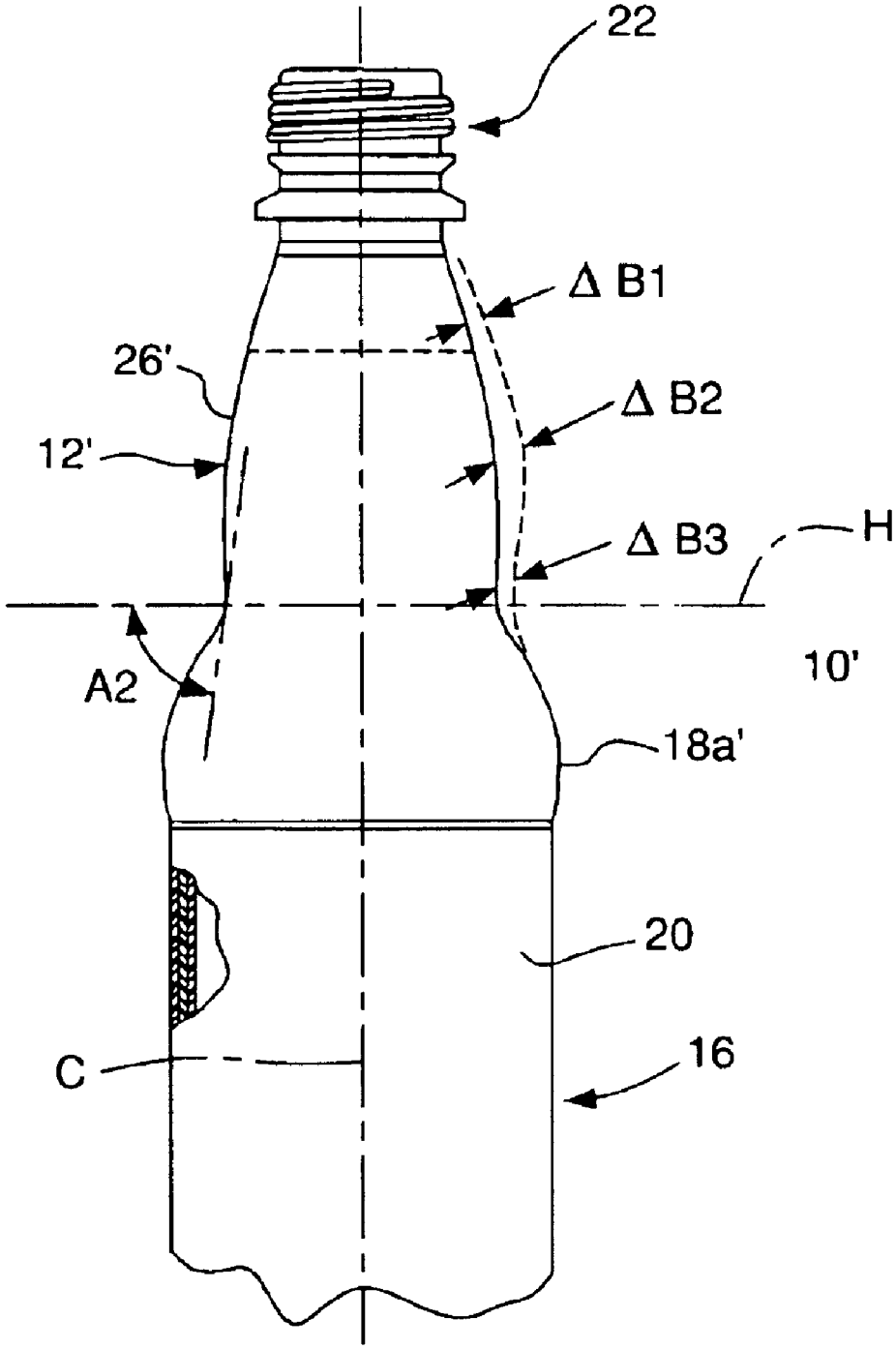
FIG. 6 is an enlarged longitudinal cross sectional view of a portion of a bottle according to another embodiment of the present invention.

As shown in FIGS. 1, 2, and 5 according to a first embodiment of the present invention, a bottle 10 includes a neck 12, a base 14, and a body 16. Body 16 is formed by a cylindrical sidewall that preferably is circular in transverse cross section (such transverse cross section is not shown in the Figures, although the circular shape of body 16 is evident from FIG. 3). Base 14 extends from a lower portion of body 16 so as to enclose the lower portion of bottle 10. Base 14, on an underside of bottle 10, preferably includes a conventional base, such as the champagne-style base shown in dashed lines in FIG. 2 and as shown in FIG. 4. Such a champagne-style base is well known and in widespread use. The present invention, however, is not limited to any particular base design, but rather encompasses any base configuration. A conventional finish 22 is disposed above an upper end of neck 12.

Body 16 may have, as shown in the Figures, shoulders 18*a* and 18*b* disposed at an upper and lower end thereof, respectively, so as to define a label panel 20 therebetween. For bottles that lack such shoulders, the label panel may be defined by any portion that is capable of receiving a label. Thus, label panel 20 is shown as cylindrical with a circular transverse cross section, although any shape capable of receiving a label may be employed.

A waist 24 smoothly extends upwardly from shoulder 18*a*, or alternatively from body 16 directly (not shown in the Figures). Waist 24 is defined by a radius R-24 such that the diameter of waist 24 is less than a diameter of shoulder 18*a* and a portion of neck 12. The particular configuration of waist 24 or radius R-24 may depend upon the particular aspects of the application in which the present invention may be employed.

Neck 12 extends upwardly from waist 24. According to an aspect of the present invention, neck 12 includes a bulge 26. Bulge 26 protrudes radially outwardly relative to a straight line between drawn between a point on a relatively lower portion of neck 12 and a point on a relatively upper portion of neck 12. Thus, bulge 26 encompasses a configuration such that the bulging portion forms substantially all of the neck (as in the Figures) and configurations in which any portion of the neck forms a bulge. Further, the present invention encompasses any configuration in which the neck is employed to expand in response to increased internal pressure.

Referring to FIG. 5, a dashed line illustrates the relative magnitude of the deformation of neck 12. The dashed line of FIG. 5 is diagrammatic such that the deformation illustrated by the dashed line is not to scale, but rather is enlarged for illustration and for clarity. The dimensions ΔA1, ΔA2, and ΔA3 indicate an upper, middle, and lower deformation from an initial state to a deformed state, thus reflecting, for example, radial deformation from an internal pressure condition at ambient temperature or cold storage temperature to an internal pressure condition at an elevated internal pressure, such as that which may be encountered upon exposure of the product to common elevated temperatures. Deformation dimension ΔA2 is taken at the position at the widest point of bulge 26.

According to another embodiment of the present invention, as illustrated in FIG. 6, a bottle 10' includes a neck 12' that extends upwardly from a shoulder 18*a*' without a transition waist. Thus, shoulder 18*a*' smoothly yields to bulge 26' such that, in longitudinal cross section, the tangents at all points from the upper portion of shoulder 18*a*' throughout bulge 26' form an angle with a horizontal line H (that is, a line perpendicular to longitudinal centerline C) that is equal to or less than 90 degrees. Such an angle is illustrated by angle A2 in FIG. 6. The present invention, however, is not limited to such a configuration. In this regard, the first embodiment bottle 10, as shown in FIG. 5, has an angle defined by a tangent of a portion of neck 12 where waist 24 yields to bulge 26 that is greater than 90 degrees. Such an angle is illustrated by angle A1 in FIG. 5.

It has been found that bulge 26 or 26' promotes volumetric expansion of neck 12 or 12' in response to an increase in internal pressure, thereby diminishing the deformation of label panel 20 and/or base 14. Such beneficial neck expansion, compared with conventional expansion illustrated by the dashed line in FIG. 7, may result from any one or combination of factors. For example, waist 24, in the first embodiment 10, or the transition from shoulder 18*a*' to bulge 26' in the second embodiment 10', may provide a hinge point or a hinge line or area that promotes deformation of bulge 26 or 26'. In this regard, the magnitude of radial deformation ΔA2 or ΔB2 may be less than a corresponding maximum deformation Δ-PA-neck (illustrated in FIG. 7) of a conventional frusto-conical neck. The present invention, however, is not limited to such relative deformation (that is, ΔA2 or ΔB2 being less than Δ-PA-neck). Rather, such relationship is described merely to provide one possible explanation of the beneficial aspects of employing bulge 26 or 26'.

In this regard, the radial deformation at the bulge midpoint ΔA2 or ΔB2 is greater than the radial deformation of the corresponding upper and lower points ΔA1, ΔA3, ΔB1, and ΔB3. However, it is anticipated that radial deformation ΔA2 will be relatively close to radial deformations ΔA1 and ΔA3, and that radial deformation ΔB2 will be relative close to radial deformations ΔB1, and ΔB3 (that is, such the radial deformations of the embodiments of the present invention will be relatively small compared with the difference between the magnitude of radial deformation Δ-PA-neck and the magnitude of deformation near corresponding upper and lower points of the conventional neck 112).

Neck 12 or 12' may be formed with particular dimensions according to the desired application, considering such parameters as bottle volume, maximum expected pressure, overall bottle design weight, and the like, as will be understood by persons familiar with bottle design technology in light of the present disclosure. Further, the present invention encompasses a bulge 26 or 26' having any cross sectional configuration.

For a sixteen ounce capacity bottle, which generally has the shape shown in FIG. 1, that was subjected to 4.5 atmospheres at 100 degrees F., the radial deformation ΔA2 was approximately 0.005 inches to 0.007 inches (that is, 0.010 inches to 0.014 inches change in diameter). The distribution of the deformation, as described above, was such that neck 12 was still suitable for receiving a label thereon.

Figure 7:
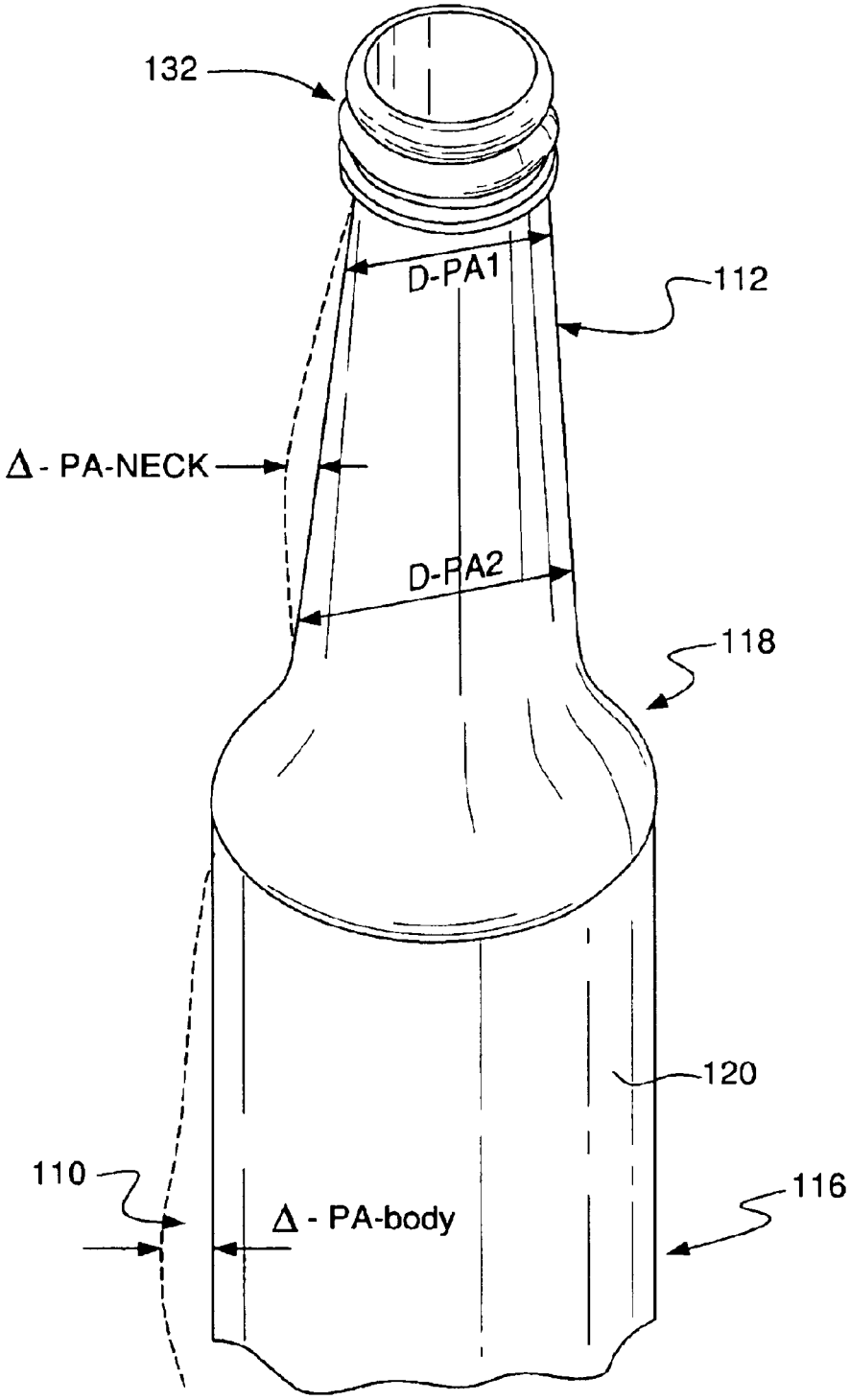
FIG. 7 (PRIOR ART)
FIG. 7 (PRIOR ART) is a perspective view of a bottle having a conventional neck shape.

Bulge 26 or 26' may be formed according to the present invention by employing either a preform that is configured specifically for such a neck 12 or 12' or a preexisting preform configuration employed for producing bottles having the conventional neck of FIG. 7. In the latter case, a conventional preform would be blown into the shape of bulge 26 or 26' such that the sidewall thickness of the bulge 26 or 26' would be less than the corresponding prior art sidewall thickness. In this regard, bulge 26 or 26' may provide greater volumetric expansion than prior art (straight-walled) neck configurations because of its geometry (as described above) or because of its diminished wall thickness relative b a prior art neck, or both in combination.

Thus, the present invention encompasses employing a bulge 26 or 26' in such a configuration in which the waist 24

(or transition structure, including shoulder 18*a*', in the second embodiment) does not act as a hinge. Similarly, the present invention encompasses employing a bulge 26 or 26' in which the bulge sidewall does not have a sidewall that is relatively thin. Rather, the present invention encompasses a sidewall that provides the volumetric expansion characteristics disclosed herein, regardless of the particular structure.

Several, and to some extent alternative, advantages flow from the present invention. Under some configurations, label panel 20 may undergo less deformation because of the volumetric expansion capacity provided by the bulge 26 or 26'. Such diminished label panel deformation may enhance the appearance of the label and/or enhance the adherence of the label to panel 20. Under other configurations, the bottle may be reduced in weight. In this regard, a bottle having a conventional neck, as roughly shown in FIG. 7, was modified so as to be configured with a neck 12 as shown in FIG. 1. The bottle having the conventional neck weighed approximately 35 grams. Employing a neck 12 on such an otherwise conventionally-shaped bottle enabled the weight of base 14 to be reduced by approximately one gram while maintaining a maximum total diameter change of body 16 under 2.5% (for a bottle held at 3.5 atmospheres at 100 degrees F.).

Bottles containing beer is an application to which the present invention may be employed. In general, converting beer containers from glass to plastic was problematic because of the poor oxygen barrier properties of blow-molded PET and the sensitivity of beer to oxygen exposure. However, recent development has employed an oxygen scavenging layer that provides excellent oxygen protection for a commercially suitable period.

In this regard, an oxygen scavenger is disclosed in U.S. Pat. No. 5,021,515, entitled "Packaging," which is incorporated herein by reference in its entirety. Oxygen barrier layers are also well known, although some multiple layers tend to separate upon repeated exposure to deformation. In this regard, the present invention may be employed with such oxygen scavenger or oxygen barrier materials or layers. Bulge 26 or 26'may also diminish layer separation in circumstances in which the maximum deformation $\Delta A2$ or $\Delta B2$ is less than $\Delta$-PA-neck.

The present invention is illustrated by disclosing particular embodiments. The present invention, however, is not limited thereto, but rather encompasses other embodiments that will be clear to persons familiar with design of pressurized bottles. For example, necks 12 and 12' have a bulge 26 and 26' formed substantially over the entire length of neck 12 and 12', respectively. Other embodiments encompassed by the present invention are referred to in the above description. The present invention also encompasses a bulge that is formed only on a portion of the corresponding neck, a neck that has a bulge interspersed with straight or flat sections, and the like.

Further, the bulge 26 and 26' are shown having a radius of curvature (in longitudinal cross section) that varies along the length or height of neck 12 and 12'. The present invention also encompasses employing bulges that have a single radius of curvature, or any other combination of radii of curvature to form any shape in longitudinal cross section or transverse cross section. More than one bulge may be employed, including a series of small bulges. Such bulges may be disposed on the neck such that one bulged is disposed above an adjacent bulge. Further, the present invention encompasses bulges formed into an accordion-like or bellows-like configuration, bulges that are not circumferentially continuous, and bulges that are not rounded.

What is claimed is:

1. A plastic container comprising:

a body defining a body diameter;

a base extending from the body and enclosing a lower end of the container;

a finish disposed at an upper end of the container, the finish having an inner diameter that is less than an inner diameter of the body;

a neck disposed between the finish and the body, the neck defining a maximum neck diameter at the widest portion thereof and including an outwardly convex portion that radially expands from its as-molded state in response to positive internal pressure, whereby the neck maximum magnitude of the radial expansion is less than a maximum magnitude of radial expansion for a frusto-conical neck of like dimension and the maximum neck diameter is less than the body diameter.

2. The container of claim 1 wherein volumetric expansion of the neck is greater than volumetric expansion for the frusto-conical neck of like dimension.

3. The container of claim 1 wherein the body is substantially cylindrical.

4. The container of claim 1 wherein the body is circular in transverse cross section.

5. The container of claim 1 wherein the bottle is formed of multiple layers.

6. The container of claim 5 wherein at least one of the layers comprises an oxygen scavenging material.

7. The container of claim 5 wherein at least one of the layers comprises an oxygen barrier material.

8. The container of claim 1 wherein the neck has a circular transverse cross section, said cross section having a smooth profile throughout the neck's height.

9. The container of claim 1 wherein the container consists of the body, the base, the neck, and the finish.

10. A. The container of claim 1 wherein the container consists of the body, the base, the neck, the finish, and a waist disposed between the body and the neck.

11. A plastic container comprising:

a body;

an base extending from the body and enclosing a lower end of the container;

a finish disposed at an upper end of the container, the finish having an inner diameter that is less than an inner diameter of the body;

a neck disposed between the finish and the body, the neck including an outwardly convex portion that radially expands in response to positive internal pressure, and a waist that is outwardly concave, the convex portion extending upwardly from and smoothly yielding from the waist, the waist forming a hinge point relative to the convex portion.

12. A plastic, pressurizable container comprising:

a body including a sidewall that is straight in longitudinal cross section, the body sidewall defining a body diameter;

a base extending from the body and enclosing a lower end of the container;

a finish disposed at an upper end of the container, the finish having an inner diameter that is less than an inner diameter of the body;

a neck disposed between the finish and the body, the neck including an outwardly convex portion that radially expands in response to positive internal pressure, the neck convex portion defining a maximum neck diameter at the widest part thereof;

and a waist that is outwardly concave, the waist defining a waist diameter that is smaller than the maximum neck diameter and smaller than the body diameter, the convex portion of the neck extending upwardly from and smoothly yielding from the waist, whereby the neck convex portion expands in response to an increase in internal pressure, the convex portion expansion diminishing expansion of the body straight sidewall, thereby enhancing the appearance and adherence of the label.

13. The container of claim 12 wherein the neck has a circular transverse cross section, said cross section having a smooth profile throughout the neck's height.

14. The container of claim 13 wherein container consists essentially of the body, the base, the neck, the waist, and the finish.

15. A plastic pressurizable container comprising:

a body including a sidewall that is straight in longitudinal cross section, the body sidewall defining a diameter;

a base extending from the body and enclosing a lower end of the container;

a finish disposed at an upper end of the container, the finish having an inner diameter that is less than an inner diameter of the body;

a neck disposed between the finish and the body, the neck including an outwardly convex portion that radially expands in response to positive internal pressures, the neck convex portion defining a maximum neck diameter at the widest part thereof, and a waist that is outwardly concave, the waist defining a waist diameter that is smaller than the maximum neck diameter and smaller than the body diameter, the convex portion extending upwardly from and smoothly yielding from the waist, whereby the neck convex portion expands in response to an increase in internal pressure, the convex portion expansion relieving internal pressure such that the overall weight of the container may be diminished relative to one having a frusto-conical neck.

16. The container of claim 15 wherein the neck has a circular transverse cross section that throughout its height is smooth.

17. The container of claim 16 wherein the container consists essentially of the body, the base, the neck, the waist, and the finish.

* * * * *